US006761752B2

(12) United States Patent
Fissan et al.

(10) Patent No.: US 6,761,752 B2
(45) Date of Patent: Jul. 13, 2004

(54) GAS PARTICLE PARTITIONER

(75) Inventors: Heinrich Fissan, Kerken (DE); Frank Jordan, Erkrath (DE); Thomas Kuhlbusch, Duisburg (DE)

(73) Assignee: Rupprecht & Patashnick Company, Inc., Albany, NY (US)

( * ) Notice: Subject to any disclaimer, the term of this patent is extended or adjusted under 35 U.S.C. 154(b) by 104 days.

(21) Appl. No.: 10/052,892

(22) Filed: Jan. 17, 2002

(65) Prior Publication Data

US 2003/0131727 A1 Jul. 17, 2003

(51) Int. Cl.[7] ..... B03C 3/12; B03C 3/74

(52) U.S. Cl. ..... 95/74; 95/79; 96/22; 96/49; 96/50; 96/73; 96/77; 96/96

(58) Field of Search ..... 96/96, 50, 49, 96/22, 73, 97, 77–79; 95/64, 74, 79; 55/DIG. 38

(56) References Cited

U.S. PATENT DOCUMENTS

| | | | | | |
|---|---|---|---|---|---|
| 1,579,462 | A | * | 4/1926 | Wintermute | 55/DIG. 38 |
| 1,605,648 | A | * | 11/1926 | Cooke | 55/DIG. 38 |
| 1,796,110 | A | * | 3/1931 | Lechler | 55/DIG. 38 |
| 1,801,515 | A | * | 4/1931 | Marshall | 55/DIG. 38 |
| 3,124,437 | A | * | 3/1964 | Lagarias | 55/DIG. 38 |
| 4,147,522 | A | * | 4/1979 | Gonas et al. | 55/DIG. 38 |
| 4,205,969 | A | | 6/1980 | Matsumoto | 96/66 |
| 4,597,780 | A | * | 7/1986 | Reif | 55/DIG. 38 |
| 4,670,026 | A | * | 6/1987 | Hoenig | 55/DIG. 38 |
| 5,024,685 | A | * | 6/1991 | Torok et al. | 96/96 |
| 5,199,257 | A | * | 4/1993 | Colletta et al. | 96/96 X |
| 6,205,842 | B1 | | 3/2001 | Patashnick et al. | 73/28.01 |
| 6,287,368 | B1 | * | 9/2001 | Ilmasti | 96/22 X |
| 6,312,507 | B1 | * | 11/2001 | Taylor et al. | 96/77 X |

FOREIGN PATENT DOCUMENTS

| | | | | |
|---|---|---|---|---|
| EP | 0803289 | | 10/1997 | |
| GB | 2016305 | * | 9/1979 | 96/96 |

* cited by examiner

*Primary Examiner*—Richard L. Chiesa
(74) *Attorney, Agent, or Firm*—Heslin Rothenberg Farley & Mesiti P.C.

(57) ABSTRACT

A gas particle partitioner (GPP) removes particles from an aerosol with high efficiency and with no or minimum changes to the thermodynamic conditions and chemical composition of the gas phase of the aerosol. A permeable grid electrode surrounds a corona wire and separates an interior corona discharge area from an exterior aerosol charging zone. A particle free fluid washes the corona discharge area to minimize any transport of gas components produced by corona discharge to the aerosol. The charged particles in the aerosol are deflected by an electric field in a fractionator to selectively produce a particle free sample stream, which is then separated by a flow splitter from the aerosol.

22 Claims, 5 Drawing Sheets

Aerosol Inlet
12
28
36
32
30
40
42
24
A
38
14
34
42
22
10
20
16
26
18
U Corona
U 1
Excess Flow
Sample Flow

GAS PARTICLE PARTITIONER

FIELD OF THE INVENTION

This invention relates generally to removal of particles from an aerosol, and, more particularly, to an apparatus and method for removing particles without appreciably affecting the thermodynamic properties or chemical composition of the gas phase of the aerosol.

BACKGROUND ART

Particles distributed in gas have various effects in the environment, technical applications, and measurement devices. To, for example, enable research investigations on particle and gas measurements, particles have to be removed from the gas phase of an aerosol. So far, mainly fabric filters and in some cases, electrical filters have been employed. However, these known approaches suffer from serious drawbacks in certain applications.

Recently, a differential particulate mass monitor which intrinsically corrects for volatilization losses has been introduced. As described in U.S. Pat. No. 6,205,842 B1, this mass monitor employs alternately activatable particle removers for selectively removing substantially all particulate matter from a gas stream, without appreciably affecting gas stream temperature, pressure and flow rate. This patent (which is hereby incorporated by reference herein in its entirety) teaches that "Such particle removal can be advantageously implemented using an electrostatic precipitator of the same general type as is commonly used in air cleaning equipment. In order to reduce ozone production, an electrostatic precipitator operating with a positive corona and very low current, e.g. on the order of tens-hundreds nanoamps, is preferred. The current should be sufficient to cause the precipitator to remove substantially all particulate matter from the gas stream." (Column 6, lines 48–56)

Ideally, a particle remover for use in such a differential particulate mass monitor should fulfill the particle separation function without affecting the gas phase thermodynamic conditions or chemical composition.

Fabric filters are available in different sizes, shapes and materials. They are used for a broad variety of applications. Small filters are used for air cleaning to protect measuring instruments and for manual sampling of ambient particles for mass concentration determinations. Large fabric filters are used to clean flue gases from industrial and power plants.

Fabric filters remove particles from a sample gas stream with high efficiency, but the pressure drop across the filter is high and increases with increasing filter loading. Hence, the gas pressure downstream of the filter is lower than the actual ambient gas pressure. Further, the gas phase of the sample is altered due to evaporation of particles at the filter surface. Also, handling of fabric filters in alternating operation is complicated. The filters have to be removed from the gas stream, when ambient particle concentrations are required behind the filter and moved back in-line when particles need to be removed. Frequent maintenance and filter changing are necessary.

In common electrostatic precipitators (ESP's), particles are charged by a corona discharge. The charged particles are deflected towards a precipitation electrode due to electrostatic forces. The size and geometrical arrangement of ESP's differ according to application requirements. Common arrangements include (multi) wire-plate (mainly for industrial use, e.g. flue gas treatment and indoor air cleaners), and pin-plate and wire-tube (both mainly for scientific, laboratory scale applications).

Common ESP's separate gas and particles with a high efficiency. The pressure drop across the ESP is generally low and alternating operation is easy by simply switching the power supply on and off. On the other hand, the gas phase of the sample is changed significantly, mainly due to formation of ozone and nitrogen oxides by the corona discharge. Another process leading to an alteration of the gas composition is evaporation of particles precipitated on the collecting electrode.

Wet ESP's are usually employed in industrial applications, such as flue gas treatment of industrial and power plants. They operate like common ESP's, but particles precipitated on the collecting electrode are flushed away by a thin water layer. This treatment prevents particles from agglomerating on the precipitation electrode surface that may form tips. These tips may cause opposite corona discharges leading to particle re-entrainment. Further, the treatment prevents particles on the collecting electrode from evaporating; although the gas phase of the aerosol is still significantly altered due to the formation of ozone and nitrogen oxides from the corona discharge. Additionally, the gas gets humidified by the water. In the differential particulate mass monitor application, for example, humidification of the aerosol could cause several severe problems, including change of the particle phase due to condensation of water on the particle surface and alteration of the particles size, mass, inertia and aerodynamic behavior; potential electrical spark-overs; and changes to the transmission of light which could lower sensitivity and hence lower reliability when used with gas sensors.

A need thus persists for a highly efficient particle remover which does not appreciably alter the thermodynamic conditions or chemical composition of the gas phase of the aerosol, the function of which is not influenced by the removed particles, and which facilitates quick and easy alternating operation.

SUMMARY OF THE INVENTION

The present invention provides apparatus and a method which overcome the deficiencies described above and provide additional significant benefits. Pursuant to the teachings of this invention, particles can be readily and efficiently removed from an aerosol with no attendant pressure drop or temperature change, and no or minimal change to the aerosol's gas composition.

In accordance with a first general aspect of the invention, apparatus for removing particles from an aerosol is provided. The apparatus includes a particle charger for imparting a charge to particles in an aerosol without affecting thermodynamic characteristics or chemical composition of the gas phase of the aerosol. Charged particles in the aerosol are deflected to provide a portion which is particle free but otherwise substantially identical to the aerosol. This portion is then physically separated from the aerosol. The particle charger may include means for aerodynamically substantially preventing any gas components produced by the particle charger from reaching the aerosol, except for ions to charge the particles.

In a second aspect, a method for removing particles from an aerosol is provided. A charge is imparted to particles in the aerosol; alteration of the chemical composition of the gas phase of the aerosol is prevented. The charged particles are deflected to produce a particle free portion which is separated from the aerosol.

In another aspect, a gas particle partitioner is provided. The partitioner includes a selectively activatable particle charger for producing charged particles in an aerosol with no appreciable change to the chemical composition of the gas phase of the aerosol. A fractionator operates on said charged particles to fractionate the aerosol into a particle laden gas stream and a particle free gas stream. A flow splitter separates said particle free gas stream from the particle laden gas stream.

The particle charger may comprise a corona discharger and a permeable electrode. Ions from the corona discharger are transported through the permeable electrode to interact with and electrically charge particles in the aerosol. The permeable electrode may separate a corona discharge area on one side of the electrode from an aerosol charging zone on another side of the electrode. A particle free fluid may wash the corona discharge area to minimize any transport of gas components produced by corona discharge from said corona discharger to the aerosol. The particle free fluid may comprise an air flow, and means may be provided for regulating the air flow and flow of the aerosol to isokinetic conditions to disallow gas exchange between the air flow and the aerosol.

The corona discharger may comprise a corona discharge wire, made, e.g. of electrically conducting material, preferably silver, switchably connectable to a corona voltage source. A permeable grid electrode may surround the corona discharge wire such that when an additional voltage is applied to the grid electrode, an electric field is produced in the space between the grid electrode and an outer wall, and ions are transported through openings in the electrode due to this electric field.

Further, means may be provided for controlling ion production by the corona discharger in response to a measurement of ionic current produced by the corona discharge. A shielded connector is advantageously employed in the measurement of ionic current.

The gas particle partitioner may also include an aerosol inlet for producing a laminar flow of the aerosol to the particle charger. The fractionator of the gas particle partitioner may include a first electrode, a second electrode spaced from the first electrode, and means for selectively applying an electric field between these electrodes, such that, when an aerosol flows between the first and second electrodes, the charged particles in the aerosol are deflected towards the second electrode by the applied electric field. The fractionator produces a particle free gas stream adjacent the first electrode and a particle laden gas stream adjacent the second electrode when the electric field is applied. The first electrode may comprise an inner cylindrical wall and the second electrode may comprise an outer cylindrical wall. The means for selectively applying an electric field between the first and second electrodes may comprise a voltage supply switchably connectable to at least one of these electrodes, and a shunt resistor for minimizing switching dead time.

The flow splitter of the gas particle partitioner may comprise a conductive ring located near an outlet of the fractionator, and means for applying a voltage to this ring.

The present invention provides numerous significant benefits and advantages. Foremost among these is the ability to separate and remove particles from an aerosol with high efficiency and without altering the thermodynamic conditions and chemical composition of the gas phase of the aerosol. Unlike fabric filters, there is no pressure drop with the present invention which permits the use of smaller pumps and provides lower acquisition and maintenance costs. Since there is no change to the thermodynamic conditions of the aerosol, measures to stabilize such conditions can be avoided. The prevention of changes to the gas composition of the aerosol enables use of the gas particle partitioner (GPP) in gas measuring devices, and reduction of unfavorable gas reactions, corrosion, etc.

Further, in the present invention, the removed particles have no influence on the functionality of the GPP resulting in longer lifetime and cost reduction. The apparatus of the present invention is also easy to switch on and off, enabling studies of particle and gas effects and interactions. An integrated isokinetic flow split avoids changes to the original particle size distribution and concentration for defined conditions. The gas particle partitioner of the present invention also exhibits low energy consumption, good chemical resistance, minimal soiling inside and easy handling. Further, the design is extremely versatile and can be used in a wide variety of applications.

BRIEF DESCRIPTION OF THE DRAWINGS

These and other aspects, features and advantages of the present invention will be more readily understood from the following detailed description of preferred embodiments when read in conjunction with the accompanying drawing figures in which.

DETAILED DESCRIPTION

Figure 1:
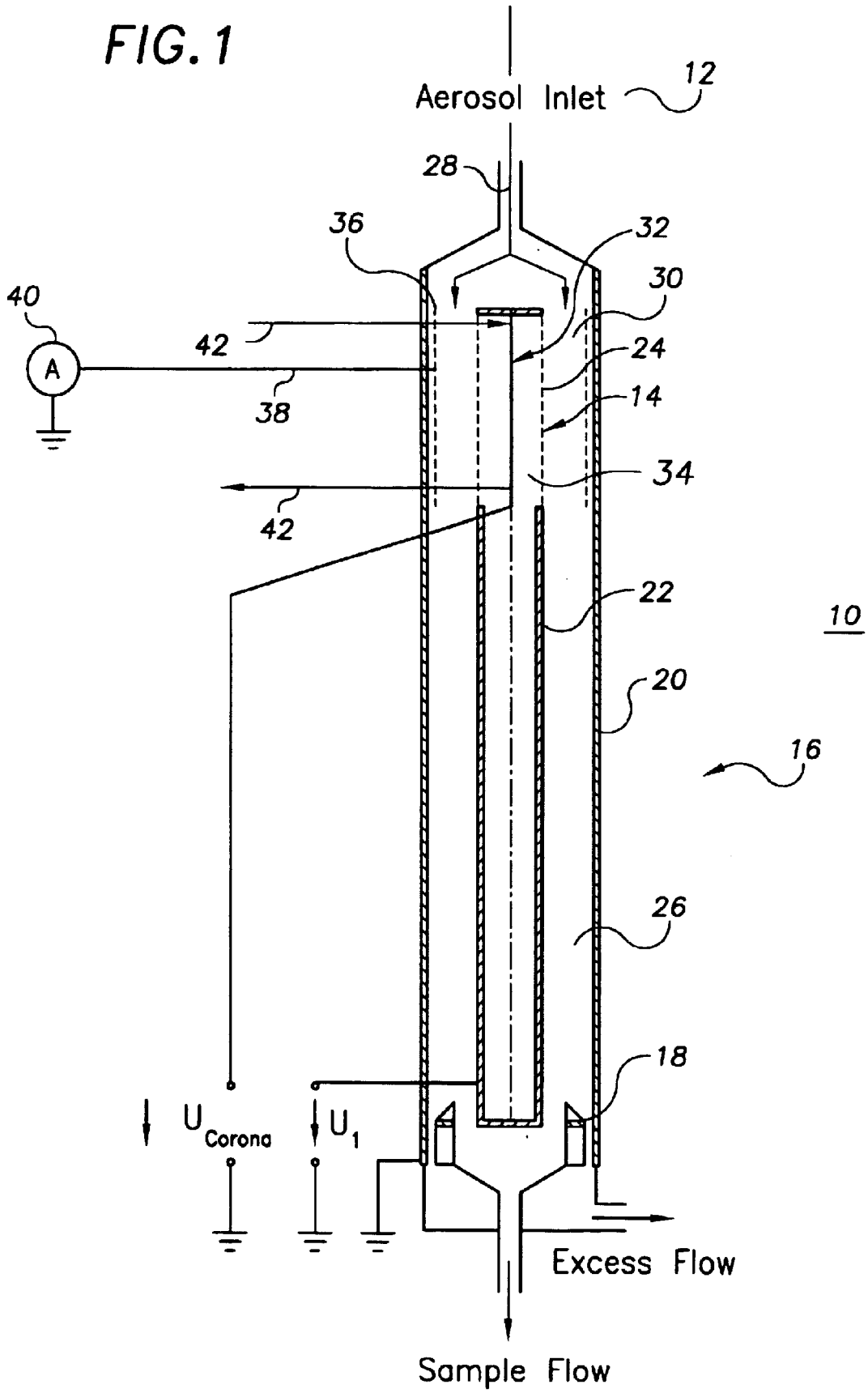
FIG. 1 is a schematic illustration of a gas particle partitioner of the present invention.

In accordance with the principles of the present invention, apparatus (hereinafter sometimes referred to as the gas particle partitioner or GPP) 10 for removing particles from an aerosol without appreciably affecting the thermodynamic conditions or chemical composition of the gas phase of the aerosol, is illustrated in FIG. 1. GPP 10 generally includes an aerosol inlet 12, a particle charger 14, a fractionator 16, and a flow splitter 18. In the illustrated embodiment, an outer cylindrical wall 20 serves as a housing for the GPP and, as more fully described hereinafter, as one of a pair of electrodes of the fractionator 16. An inner cylindrical wall 22 serves as the other electrode of fractionator 16, and also supports a cylindrically shaped, permeable grid electrode 24 of particle charger 14. Inner wall 22 and outer wall 20 define an annular space 26 through which the aerosol flows within the GPP 10.

Aerosol 28 is led into the GPP through aerosol inlet 12. The aerosol inlet is advantageously designed to achieve a laminar flow and even distribution of the aerosol within GPP 10, with minimum particle losses due to impaction, interception and diffusion. The aerosol inlet may take different forms, e.g. an upside down funnel on the outside with an ellipsoidal or conical stream line routing on the inside.

From inlet 12, aerosol 28 enters an aerosol charging zone 30 in the annular space between permeable grid electrode 24 and outer wall 20. An axially extending corona wire 32 within cylindrically shaped permeable grid electrode 24 produces a corona discharge area 34 about wire 32, when a voltage $U_{Cor}$ is applied to the wire. Corona wire 32, made of electrically conducting material, advantageously silver, serves as a controlled corona discharger for unipolar charging of particles in aerosol 28. The corona discharger produces high concentrations of ions which are transported through openings in permeable grid electrode 24 to interact with and electrically charge aerosol particles in aerosol charging zone 30.

A voltage $U_1$ is applied from a voltage supply to permeable grid electrode 24 to produce an electric field. Ions produced by the corona discharge from wire 32 are transported through openings in electrode 24 due to this electric field. The ion production is, preferably, monitored and can be controlled by measuring the ionic current with a measuring electrode 36 (e.g. of aluminum foil), a shielded connector 38 and a current meter 40. Computer or other control means, responsive to the measurements of ionic current by meter 40, can be advantageously employed to control ion production by the corona discharger.

Corona discharge area 34 is separated from aerosol charging zone 30 by permeable grid electrode 24. The corona discharge area is washed or flushed with a particle free airflow 42 to minimize any transport of gas components produced by the corona discharge process to the aerosol 28. Mixing of the wash flow 42 with the aerosol flow is minimized by the separating grid electrode 24, and isokinetic conditions inside and outside the corona discharge area 34. These measures eliminate or substantially minimize changes to the chemical composition of the aerosol.

Preferably, corona wire 32 and permeable grid electrode 24 are switchably connectable to their respective power supplies. Thus, particle charger 14 is selectively activatable. When activated, the particle charger imparts unipolar (e.g. positive) charges to particles in aerosol charging zone 30 without appreciably affecting the thermodynamic properties or chemical composition of the gas phase of the aerosol 28. No ions are produced and no changes to the aerosol occur in the charging zone when the corona discharger is switched off.

Figure 2:
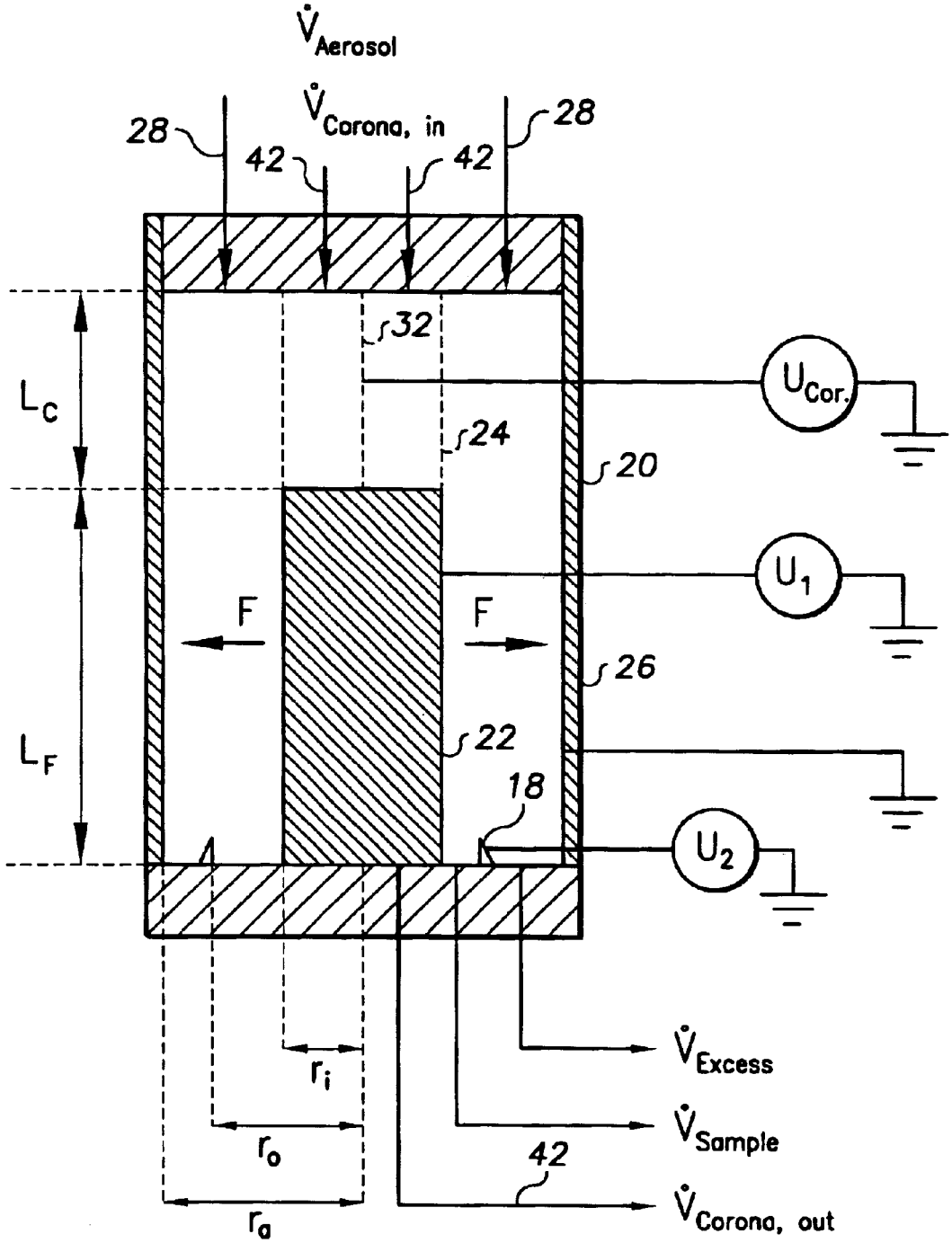
FIG. 2 is a schematic illustration of the particle charging and fractionation sections of the GPP.

After passing through charging zone 30, aerosol 28 enters the annular space 26 of fractionator 20. Inner wall 22 serves as a first electrode. An outer wall 20 serves as a second electrode of fractionator 16. Outer wall 20 may be grounded while a voltage $U_1$ is applied to inner wall 22, producing an electric field F in a generally radially outward direction, as illustrated in FIG. 2. If the particle charger and fractionator are active, (i.e. $U_{Cor}$ and $U_1$ voltages applied), charged particles 44 in aerosol 28 are deflected by electric field F, and transported in the direction of outer wall (second electrode) 20. Accordingly, electrically charged particles 44 in the aerosol are transported by the electric field F (coulomb force) according to their charge and size when the gas particle partitioner is switched on. This produces a particle free portion or gas stream 46 adjacent inner electrode 22. Charged particles 44 may be deposited on outer wall 20 or transported out of the GPP in a particle laden gas stream 48 adjacent outer electrode 20. In the latter case, the gas particle partitioner can also serve as a particle concentrator. The different modes can be achieved by changing the strength of electric field F or the length $L_F$ of fractionator 16.

Figure 3:
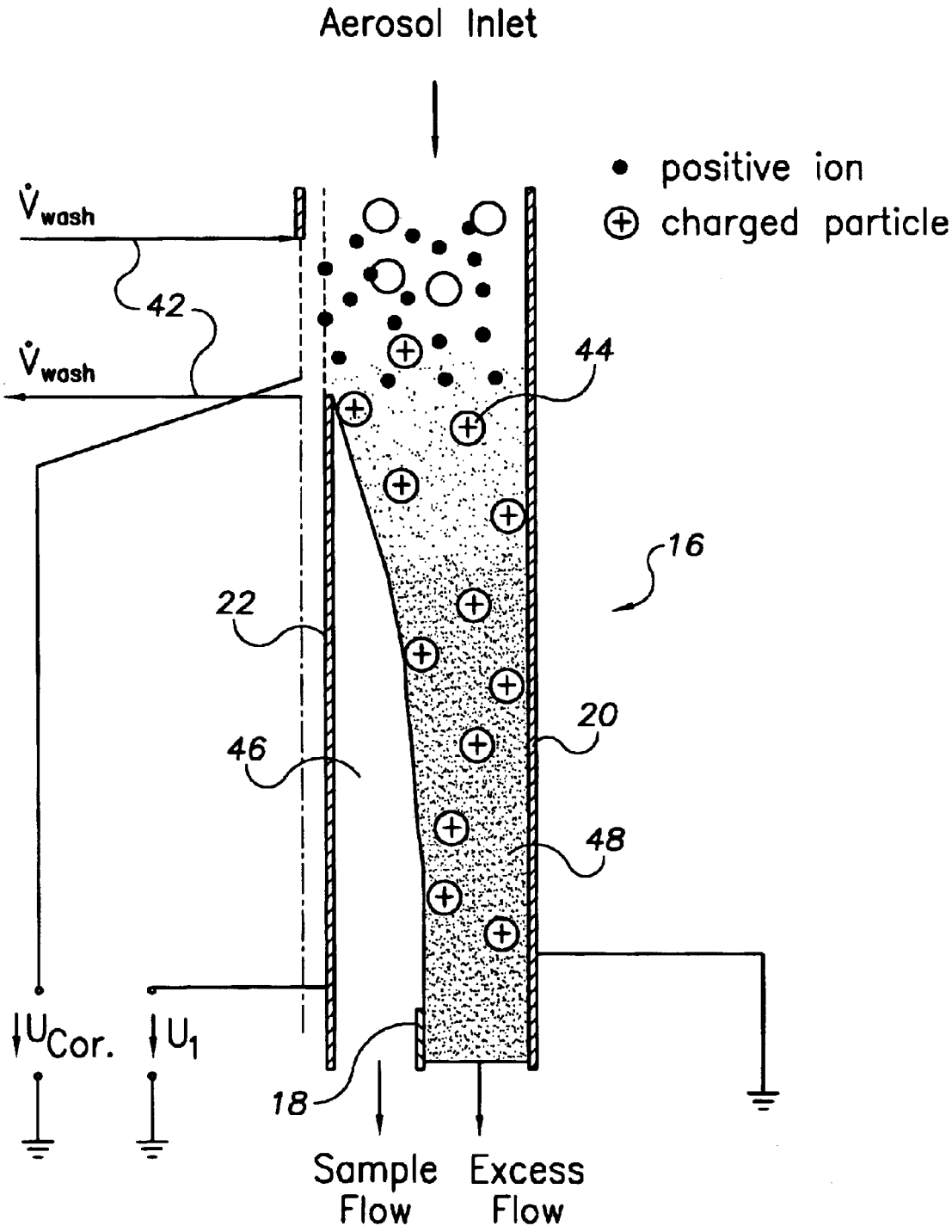
FIG. 3 illustrates the operation of the GPP when the particle charger and fractionator are activated.

Flow splitter 18 physically separates the particle free gas stream 46 from particle laden gas stream 48. The particle free gas stream 46 can be used as a sample flow for a differential particulate mass monitor of the type described in U.S. Pat. No. 6,205,842 B1, while particle laden gas stream 48 is treated as excess flow, as illustrated in FIG. 3. By removing the particles with the excess flow and due to the fact that the excess flow passes the deposited particles, evaporation of material from the walls of the fractionator will only influence the excess flow and not the sample flow.

Figure 4:
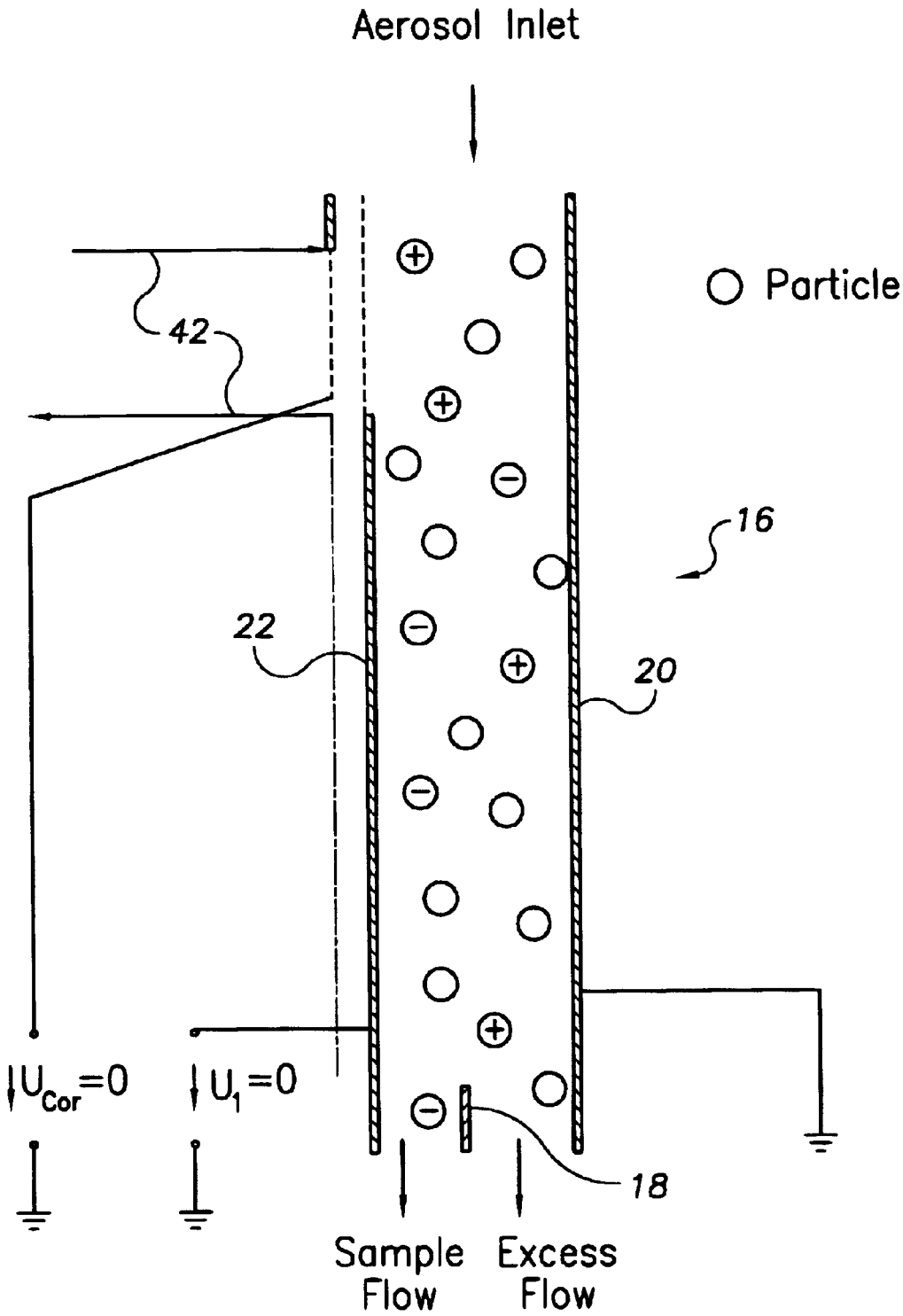
FIG. 4 illustrates operation of the GPP when the particle charger and fractionator are inactive.

As depicted in FIG. 3, the sample flow is particle free if the particle charger and fractionator are active. As shown in FIG. 4, the sample flow will be unaltered (physically and chemically) compared to the inlet flow if the GPP is switched off (i.e. no voltages applied). The GPP is thus, ideally suited to serve as a particle remover in a differential particulate mass monitor, as well as in a wide variety of other applications.

If flow splitter 18 is a conductive ring, this ring may not be grounded. Otherwise, the grounded ring will influence the electric field F near the outlet of the fractionator 16. This would lead to a higher longitudinal velocity and may cause particles to get into the sample flow. Accordingly, if the flow splitter 18 is manufactured from electrically conductive material, a partial voltage $U_2$ should be applied to flow splitter 18, as illustrated in FIG. 2, to leave the electric field in the vicinity of the outlet unaltered.

Exemplary values for the geometric, electrical and flow rate parameters shown in FIG. 2, are now presented.

| Symbol | Description | Exemplary Value |
|---|---|---|
| $r_i$ | Radius of the inner wall 22 | 2 cm |
| $r_a$ | Radius of the outer wall 20 | 5 cm |
| $r_o$ | Radius of the flow splitter 18 | 3.3231 cm |
| $U_{Cor.}$ | Corona voltage | 8–12 KV |
| $U_1$ | Voltage of the inner electrode 22 | 1000 V |
| $U_2$ | Voltage at flow splitter 18 | 445.86 V |
| $L_C$ | Length of the charging zone | 5 cm |
| $L_F$ | Length of fractionator 16 | 15 cm |
| $V_{Aerosol}$ | Flow rate of the aerosol flow | 8.33 l/min |
| $V_{Sample}$ | Sample air flow rate | 3 l/min |
| $V_{Excess}$ | Excess air flow rate | 5.33 l/min |
| $V_{Corona}$ | Wash air flow rate | 1.6 l/min |

Figure 5:
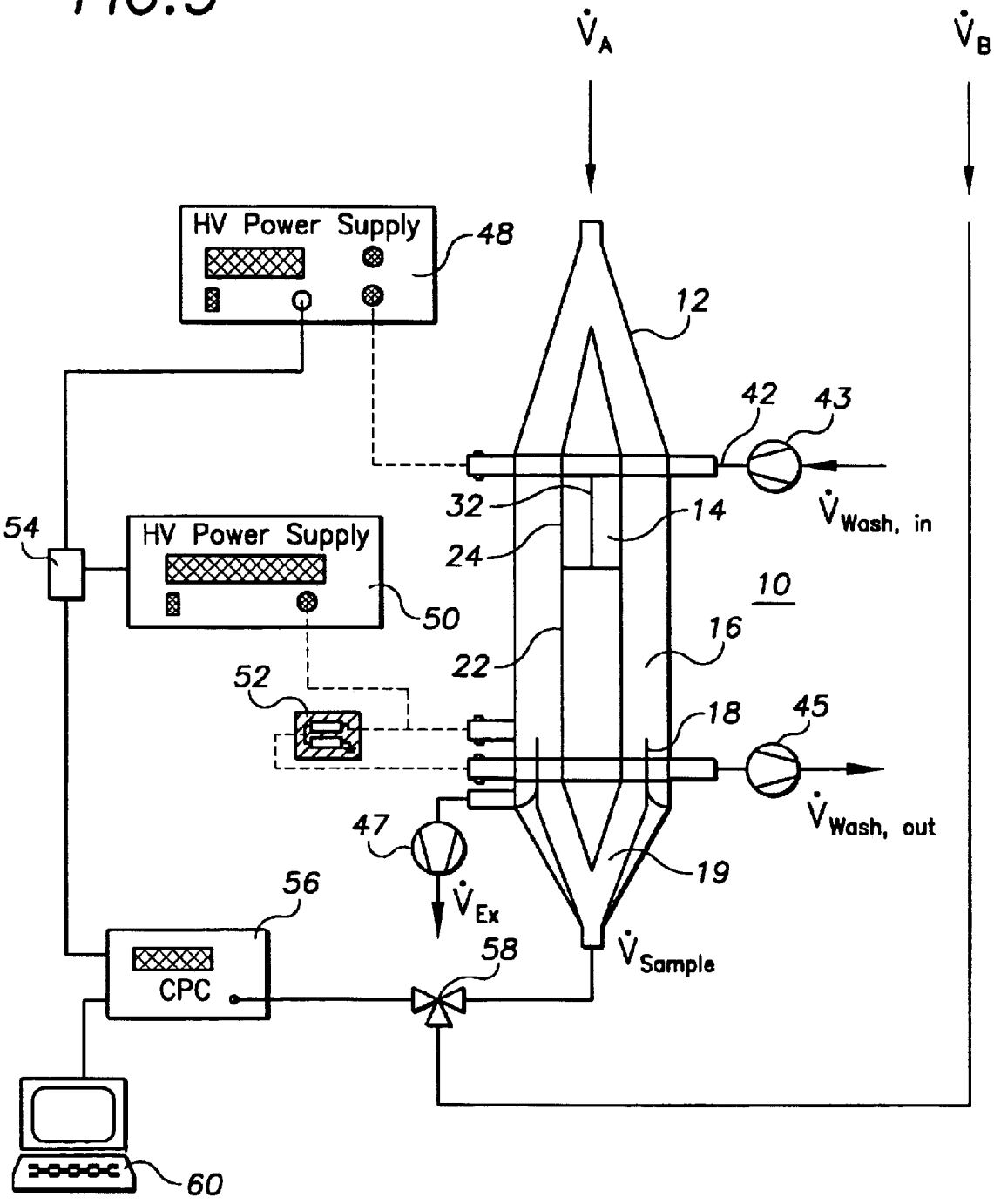
FIG. 5 depicts an experimental setup of a prototype GPP.

FIG. 5 is a simplified view of an experimental prototype of the GPP, and associated equipment. GPP 10 includes aerosol inlet 12 (of the upside down funnel-conical stream routing type), particle charger 14 (including corona wire 32 and surrounding permeable grid electrode 24), fractionator 16, electrically conductive flow splitter 18 and sample outlet 19. The corona discharge area interior of electrode 24 is washed with a particle free air stream 42.

Pumps 43, 45 and 47, along with filters and mass flow controllers (not shown) establish the desired flow rates.

An adjustable high voltage power supply 48 provides corona voltage $U_{Cor.}$ to corona wire 32. The corona voltage may be adjusted by computer or manually, in a fashion well known in the art. The supply of voltage $U_1$ to inner electrode 22 and of voltage $U_2$ to conductive flow splitter 18 is realized by one high voltage supply 50. The two different voltages $U_1$ and $U_2$ are obtained through high resistive voltage divider 52. A relay 54 allows simultaneous switching of high voltage power supplies 48 and 50.

To measure particle concentration in the sample flow, a condensation particle counter (CPC) 56 was used. Since the inlet flow of CPC 56 was either 0.3 l/min or 1.5 l/min and the sample flow from GPP 10 was 3 l/min, in the experiments, a flow split downstream of the GPP was employed. A three way valve 58 between the flow split and CPC 56 allowed measurement of the total particle concentration in ambient air $V_{By}$. Computer software resident in personal computer 60 was used to read the concentrations from CPC 56 and to adjust the corona voltage $U_{Cor}$.

Measurements have been performed using the experimental setup of FIG. 5, with ambient laboratory air. Standard values that were used for the measurements are:

$$V_{Sample} = 3\ \frac{l}{min}$$

$$V_{Ex} = 5.33\ \frac{l}{min}$$

$$V_{wash} = 1.6\ \frac{l}{min}$$

$$U_1 = 1000\ V$$

$$U_2 = 446\ V$$

The flow rate of the washing air was chosen to achieve the same average velocity of the aerosol flow. The corona voltage was varied to obtain the dependency of the separation on the corona discharge voltage. Prior to the separation behavior measurements with applied voltages, the particle losses inside the GPP were studied. Particle losses with no applied voltages, have shown to be low (about 1%), if the standard flow rates are maintained.

For the first measurements of the separation behavior, the standard voltages and flow rates were adjusted and the separation efficiency was calculated from the measured ambient and sample concentrations. The corona potential was varied from 0 V to 11 kV. The corona potential is the voltage of the corona wire 32 against ground potential. The actual corona voltage is the difference between the corona wire potential and the grid electrode potential $U_1$, i.e. in this case, the corona voltage varied from −1 kV to +10 kV. The disruptive discharge voltage is around 5 kV corona potential, i.e. at around 4 kV corona voltage.

Next, a series of measurements were performed to determine a possible influence of the washing air on the separation efficiency. No significant change in separation behavior was observed due to the use of washing air.

Next, it was investigated whether the polarity of the corona potential has a significant influence on the separation. Generally, a positive corona potential was chosen to be used with the GPP because it is expected to produce less amount of ozone and nitrogen oxides. No significant differences were observed up to a corona potential of approximately 8 kV. For potentials higher than 8 kV, the separation is higher for positive than for negative polarity.

Gold wire is commonly used in conventional ESP's. Silver was chosen as the corona wire material to keep the formation of gases like ozone and nitrogen oxide low. Separation efficiency was found to be higher, when a silver wire, rather than a gold wire, was used. This result was continuously found for several measurements.

The voltage $U_1$ applied to inner electrode 22 was increased to 1500 V, and the voltage of the flow splitter 18 was increased by the same factor to 669 V. A comparison of the separation behavior for 1000 V and 1500 V was then undertaken. For a voltage of 1500 V, the results show a significantly increased efficiency. The maximum separation was about 96.5%. The rest up to 100% may be due to uncharged nanoparticles. Nanoparticles may be insufficiently charged by a corona discharge, but, on the other hand have a negligible mass compared to the larger particles that are assumed to be separated from the sample flow in the GPP.

It took approximately 8 seconds after switching the corona voltage on, before the concentration in the sample stream started to decrease (dead time of the GPP). To determine the dynamic response of the GPP, the particle concentration in the sample stream after switching on or off the corona voltage was measured in short time steps. The dynamic response of the GPP should be as fast as possible. Taking a dead time of 8 seconds into account, the total $t_{90}$ time (i.e. the time it takes to reach 90% of the final separation level) for corona voltages above 8 kV were determined to be higher than 16 seconds.

In order to keep the dead time low, the velocity inside the GPP can be increased and hence the total volume inside the GPP will be decreased. A slimmer or shorter design of the GPP will also cause it to become lighter.

Investigations have shown that the corona wire in the GPP may be used for a long time with no significant deterioration of the separation efficiency. A changing interval for the corona wire 32 is expected to be at least in the range of months.

Finally, frequent cleaning of the GPP is not required since a large fraction of the particles does not get deposited on the electrodes 20, 22, but is carried out of the GPP with the excess air flow. Since the sample air flow is geometrically separated from the outer electrode 20, particulate matter deposited on the outer electrode, may not reach the sample air flow. Accordingly, maintenance intervals for the GPP are expected to be much longer than those of conventional ESP's.

The gas particle partitioner of the present invention can be used in different areas of technical applications and in measurement devices, including, but not limited to:

1. Measurement devices to determine particle mass concentrations can be influenced by gas components. The GPP can be used to determine and quantify these influences. It may also be used for the de-correlation of gas and particle effects.
2. Since the GPP removes particles from the gas phase with no or little change to the gas phase, it can also be employed in gas monitors for e.g. $CO_2$, CO, $H_2O$, $NO_2$, $NH_3$, $H_2$, HS, $CH_4$, etc.
3. It can be used as a pre-filter before mass-flow-controllers, flow measurement devices, pressure gauges, temperature sensors and other sensors as well as a general filter in low flow systems.
4. It can be employed as a filter in clean boxes.

The gas particle partitioner removes particles from an aerosol with high efficiency and no or minimal changes to the chemical composition and thermodynamic conditions of the gas phase. It is versatile in design and adaptable to various areas of applications. Other major advantages of the device are that it can easily be switched on and off and externally controlled. No interference of the aerosol will occur when the GPP is switched off. Further, the GPP is energy efficient, compact and mechanically robust.

Although preferred embodiments have been described and depicted herein, it will be readily apparent to those skilled in the art that various modifications, substitutions, additions and the like can be made without departing from the claimed invention. For example, the aerosol inlet, particle charger, fractionator, and flow splitter may take different forms than those illustrated herein, provided that the thermodynamic conditions and chemical composition of the gas phase of the aerosol are not appreciably affected during operation of the GPP. These and other variations which fall within the scope of the appended claims are considered to be part of the present invention.

What is claimed is:

1. A gas particle partitioner, comprising:

a particle charger for producing charged particles in a flow of an aerosol with no appreciable change to thermodynamic conditions and chemical composition of a gas phase of the aerosol, said particle charger including a source of ions located outside said flow of said aerosol;

a fractionator for operating on said charged particles to fractionate said aerosol into a particle laden gas stream and a particle free gas stream; and a gas flow splitter for separating said particle free gas stream from said particle laden gas stream.

2. The gas particle partitioner of claim 1, wherein the particle charger is selectively activatable, the charged particles produced by said particle charger are unipolar charged, and the particle charger produces no change to the aerosol when inactivated.

3. The gas particle partitioner of claim 2, wherein said particle charger comprises a corona discharger and a permeable electrode extending substantially parallel to said flow; and wherein ions from said corona discharger are transported through said permeable electrode to interact with and electrically charge particles in said aerosol, whereby said charged particles are produced.

4. The gas particle partitioner of claim 3, wherein said permeable electrode separates a corona discharge area on one side of said electrode from an aerosol charging zone on another side of said electrode, and further comprising means for washing said corona discharge area with a particle free fluid to minimize any transport of gas components produced by corona discharge from said corona discharger to the aerosol.

5. The gas particle partitioner of claim 4, wherein said particle free fluid comprises an air flow substantially parallel to the flow of said aerosol, and further comprising means for regulating said air flow and flow of said aerosol to isokinetic conditions to disallow gas exchange between said air flow and said aerosol.

6. The gas particle partitioner of claim 5, wherein said permeable electrode comprises a permeable grid electrode, and said ions are transported through openings in said permeable grid electrode.

7. The gas particle partitioner of claim 6, wherein said corona discharger comprises a corona discharge wire switchably connectable to a corona voltage source.

8. The gas particle partitioner of claim 7, wherein said corona discharge wire comprises electrically conducting material.

9. The gas particle partitioner of claim 7, wherein said permeable grid electrode surrounds said corona discharge wire, said corona discharge area is interior of said electrode, and said aerosol charging zone is outside of said electrode.

10. The gas particle partitioner of claim 9, wherein a voltage is applied from a voltage supply to said permeable grid electrode to produce an electric field, and said ions are transported through openings in said electrode due to said electric field.

11. The gas particle partitioner of claim 4, further comprising first means for measuring ionic current produced by said corona discharge, and second means, responsible to said first means, for controlling ion production by said corona discharger.

12. The gas particle partitioner of claim 11, wherein said first means includes a shielded connector.

13. The gas particle partitioner of claim 1, further comprising an aerosol inlet for producing a laminar flow of the aerosol to said particle charger.

14. The gas particle partitioner of claim 1, wherein said fractionator comprises a first electrode, a second electrode spaced from said first electrode, and means for selectively applying an electric field between said first and second electrodes, whereby when said aerosol flows between said first and second electrodes, the charged particles in said aerosol are deflected by said applied electric field towards said second electrode.

15. The gas particle partitioner of claim 14, wherein said fractionator produces a particle free gas stream adjacent said first electrode and a particle laden gas stream adjacent said second electrode when said electric field is applied.

16. The gas particle partitioner of claim 15, wherein said first electrode comprises an inner cylindrical wail and said second electrode comprises an outer cylindrical wall.

17. The gas particle partitioner of claim 16, herein said flow splitter comprises a conductive ring located near an outlet of the fractionator, and means for applying a voltage to said ring.

18. The gas particle partitioner of claim 14, wherein said means for selectively applying an electric field comprises a voltage supply switchably connectable to at least one of said first and second electrodes, and a shunt resistor for minimizing switching dead time.

19. The gas particle partitioner of claim 8 wherein said conducting material comprises silver.

20. Apparatus for removing particles from an aerosol, comprising:

a particle charger for imparting a charge to particles in a flow of an aerosol without affecting thermodynamic characteristics or chemical composition of a gas phase of the aerosol, said particle charger including a source of ions located outside said flow of said aerosol;

means for deflecting charged particles in the aerosol to provide a portion which is particle free but otherwise substantially identical to said aerosol; and means for physically separating said portion from the aerosol.

21. The apparatus of claim 20 wherein said particle charger includes means for aerodynamically substantially preventing any gas components produced by said particle charger from reaching said aerosol, except for ions to charge the particles.

22. A method for removing particles from a flow of an aerosol, comprising:

imparting a charge to particles in the flow of the aerosol with an ion source located outside said flow;

preventing alteration of chemical composition of a gas phase of the aerosol;

deflecting charged particles in the aerosol to produce a particle free portion; and separating said particle free portion from the aerosol.

* * * * *